US008967894B2

(12) United States Patent
Jeong

(10) Patent No.: US 8,967,894 B2
(45) Date of Patent: Mar. 3, 2015

(54) MASCARA BRUSH

(75) Inventor: Hae-won Jeong, Seoul (KR)

(73) Assignee: Amorepacific Corporation, Seoul (KR)

( * ) Notice: Subject to any disclaimer, the term of this patent is extended or adjusted under 35 U.S.C. 154(b) by 273 days.

(21) Appl. No.: 13/640,285

(22) PCT Filed: Apr. 1, 2011

(86) PCT No.: PCT/KR2011/002259

§ 371 (c)(1),
(2), (4) Date: Oct. 9, 2012

(87) PCT Pub. No.: WO2011/126237

PCT Pub. Date: Oct. 13, 2011

(65) Prior Publication Data

US 2013/0045039 A1 Feb. 21, 2013

(51) Int. Cl.

| | |
|---|---|
| ***A46B 11/08*** | (2006.01) |
| ***A46B 7/02*** | (2006.01) |
| ***A46B 9/02*** | (2006.01) |
| *A45D 40/26* | (2006.01) |

(52) U.S. Cl.

CPC ..... *A46B 7/02* (2013.01); *A45D 40/265* (2013.01); *A46B 9/021* (2013.01); *A46B 2200/1053* (2013.01)

USPC ..... 401/1; 401/126; 312/218

(58) Field of Classification Search

CPC ..... A46B 9/021; A46B 2200/1053

USPC ..... 401/1, 126–130; 132/216, 218

See application file for complete search history.

(56) References Cited

FOREIGN PATENT DOCUMENTS

EP 1974627 A1 * 10/2008

* cited by examiner

*Primary Examiner* — David Walczak
*Assistant Examiner* — Jennifer C Chiang
(74) *Attorney, Agent, or Firm* — John K. Park; Park Law Firm

(57) ABSTRACT

A mascara brush capable of achieving the volume-up and curling of eyelashes by raising eyelashes with a mascara material applied is provided. The mascara brush is withdrawn from a mascara container, a button on the top of a grip is pressed, and then the brush is bent from a brush rod in an arc shape by a working member within a brush base, to prevent mascara materials adhered to a mascara rod from staining the periphery of eyes or nose, thereby providing a convenient use.

8 Claims, 5 Drawing Sheets

MASCARA BRUSH

TECHNICAL FIELD

The present invention relates to a mascara brush, and particularly, to a mascara brush capable of achieving the volume-up and curling of eyelashes by raising eyelashes with a mascara material applied, wherein the mascara brush is withdrawn from a mascara container, a button on a grip is pressed, and then the brush is bent in an arc shape by a working member within a brush base, to prevent mascara materials adhered to a mascara rod from staining the periphery of eyes or nose, thereby providing a convenient use.

BACKGROUND OF THE INVENTION

A make-up for eyelashes is generally used to embellish eyes and create a more beautiful face. A representative tool used for the make-up of eyelashes is mascara. The mascara is a cosmetic dedicated to eyelashes, which is applied to eyelashes to create voluminous and long eyelashes, and it is used with a mascara brush and a mascara material adhered thereto. That is, when making up eyelashes using the mascara brush, a mascara material is adhered to the mascara brush, and the mascara material adhered is evenly applied to eyelashes by combing and raising eyelashes using the mascara brush. The applying of mascara material to eyelashes and raising the eyelashes make the make-up of eyelashes more beautiful. Thus, a mascara brush is used for applying a mascara material to eyelashes and curling the eyelashes voluminously.

Generally, a mascara brush is integrated with a cap of a container containing a mascara material, the cap serves as a grip, and the brush is provided at a distal end of a straight brush rod associated with one end of the cap.

In the cap-integrated mascara brush, the brush and brush rod are immersed into the mascara material when the mascara brush is sealed by closing the container with the cap. Therefore, when making up eyelashes using such a mascara brush, as shown in FIG. 1, there is a problem that mascara materials adhered to the brush rod may stain a face, particularly the periphery of eyes or nose.

Further, mascara brush 1 is generally formed as a straight shape; however, such a straight brush may be unsuitable for curling curved eyelashes.

SUMMERY

The present invention has been invented to solve the above problems. It is an object of the present invention to provide a mascara brush having a brush being able to be bent from its brush rod in an arc shape when making up eyelashes, in order to prevent mascara materials adhered to the brush rod from staining the periphery of eyes or nose, thereby providing a convenient use.

To achieve the above object, according to the present invention, provided is a mascara brush provided with a brush rod having a brush at one side of a grip, the brush rod is inserted into a mascara container, wherein the brush is bent in an arc shape after it is withdrawn from the mascara container; the brush provided at the one side of the grip includes a working member comprising a first plate and a second plate having different thermal extension coefficients, and a brush base having brush hairs which encloses tightly the outside of the working member; a button is provided on the top of the grip, and a switch, a terminal, a battery, a terminal and an insert terminal are sequentially associated the inside beneath the button; electric wires for connecting electrically the first and second plates, respectively, to the insert terminal are installed in the inside of the brush rod.

As described above, the mascara brush according to the present invention can prevent mascara materials adhered to a mascara rod from staining the periphery of eyes or nose, wherein a mascara brush is withdrawn from a mascara container, a button on the top of a grip is pressed, and then the brush is bent from its brush rod in an arc shape by a working member within a brush base, thereby providing a convenient use.

DETAILED DESCRIPTION OF THE INVENTION

It should be noted that the interpretation of terms and words used herein are not limited to their common meanings known in the art, but they may be understood as any meaning and concept which conform to a technical spirit of the present invention based on the rule that the inventor can define appropriately the concept of a term to explain optimally the inventor's own invention.

Hereinafter, various embodiments of the present invention will be described in detail with reference to the accompanying drawings.

Figure 1:
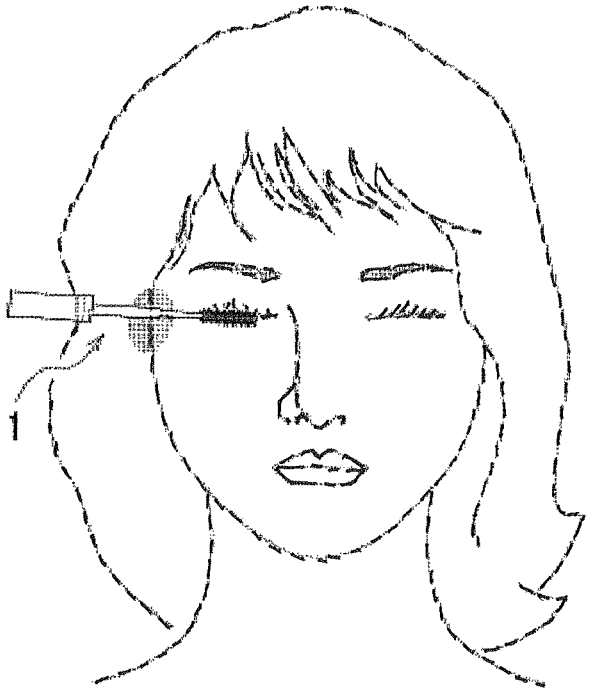
FIG. 1 is a front view showing a structure of a general mascara brush in use.
Figure 2:
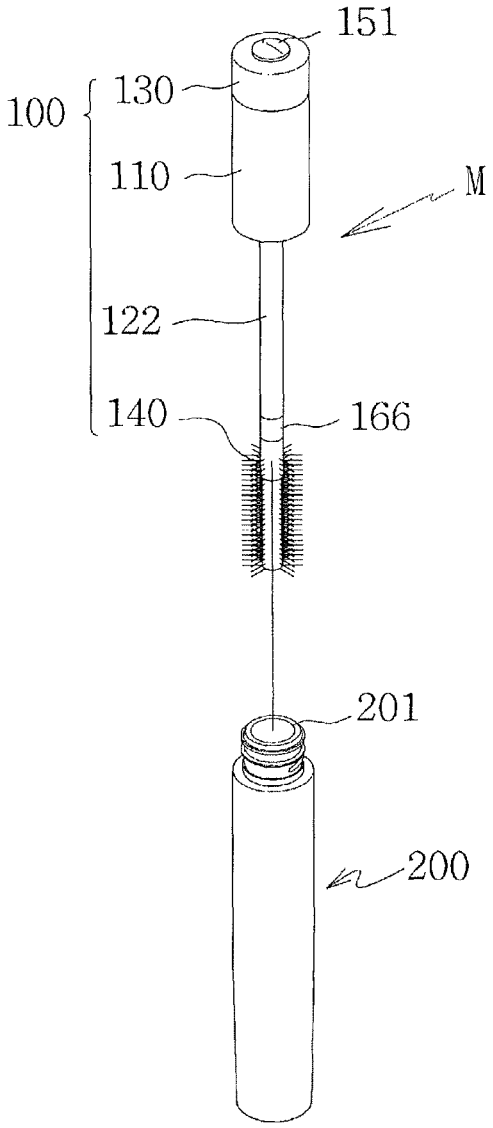
FIG. 2 is a perspective view showing a mascara brush according to the present invention, a grip being separated from a container.
Figure 3:
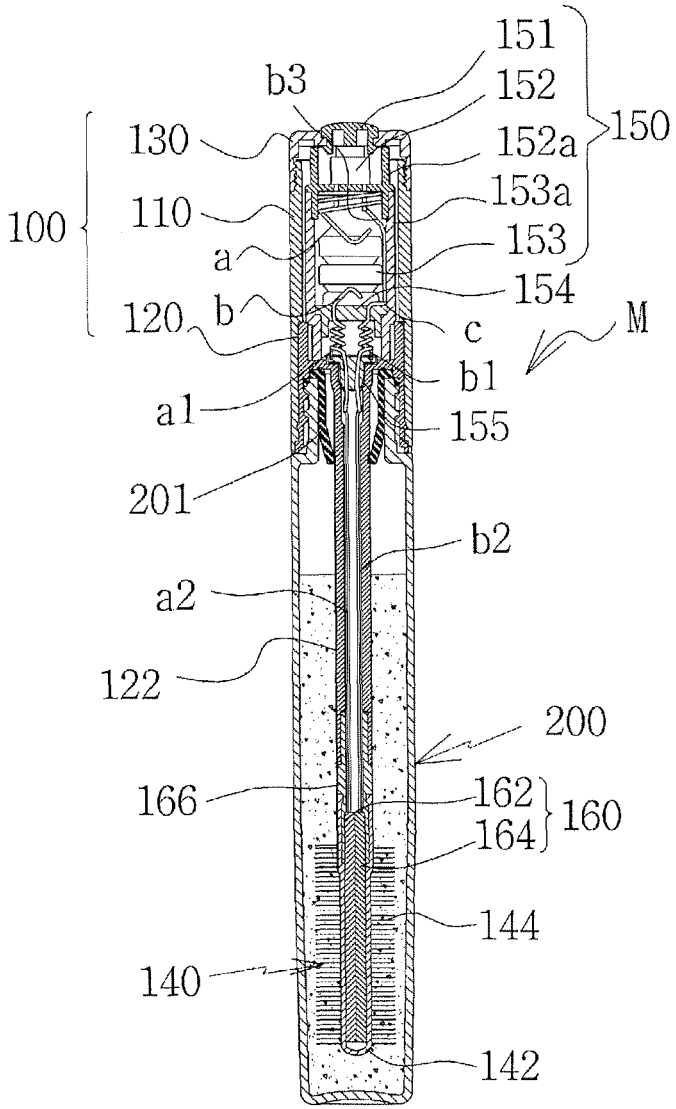
FIG. 3 is a cross-section view of FIG. 2, a grip being associated with a container.

First, a mascara brush according to the present invention is shown in FIGS. 2 and 3. Main body M of the mascara brush consists of grip 100 comprising outer cap 110, inner cap 120, button cap 130, brush 140, control member 150 and working member 160, and container 200.

Outer cap 110 is formed as a hollow cylindrical body where the top and bottom are opened. A screw member is formed on the outer peripheral surface of the upper portion of outer cap 110, button cap 130 is associated or separated by the screw member, and switch holder 152*a*, battery holder 153*a* and inner cap 120 are sequentially associated in the inside.

Inner cap 120 has a screw member formed on the inner peripheral surface of the lower portion, which corresponds to a screw member formed on the outer peripheral surface of the mouth portion of container 200. Inner cap 120 and container 200 are associated or separated by the screw member. Also, a septum is formed in the center of inner cap 120, brush rod 122 is formed at the lower portion of septum, and terminal packing 155 is associated at the upper portion of septum.

Brush rod 122 is formed as a hollow rod body where one end may be inserted securely into the center of septum of inner cap 120 or may be integrated with inner cap 120. Working member holder 166 and brush base 142 having brush hairs 144 are sequentially associated at the distal end of brush rod 122.

Button cap 130 is formed as a cylindrical body where the bottom only is opened. Button 151 is associated at the center of the upper surface of button cap 130, and a screw member is formed on the inner peripheral surface of the lower portion, which corresponds to the screw member formed on the upper peripheral surface of outer cap 110.

Brush 140 has flexible, resilient and insulating properties, and has a form that brush hairs 144 are implanted into brush base 144 which is a tube type having one end opened. The brush base is flexible and resilient, and it may be formed of silicones or elastic polymers, for example Elastomer. Brush hairs 144 may be a brush implanted into brush base 142, or they may be integrated with the brush base 142 where the brush hairs may be the same material as the brush base.

A working member 160, a first plate 162 and a second plate 164 are inserted in the inside of brush base 142.

Control member 150 which drives working member 160 comprises switch 152 mounted in switch holder 152*a* beneath button 151, battery 153 inserted in the inside of battery holder 153*a*, terminals (a, b, c), insert terminals (a1, b1) and electric wires (a2, b2, b3).

Terminal is located between +terminal of battery 153 and the bottom of switch holder 152*a*. Terminal b is connected to insert terminal a1 on the basis of terminal packing 155, and the upper portion of terminal b is located at −terminal of battery 153. Terminal c is connected to insert terminal b1 on the basis of terminal packing 155, and one end of terminal c is connected to wire b3 which is connected to switch 152.

Insert terminal a1 is connected electrically to a first plate 162 through wire a2 installed inside brush rod 122, and insert terminal b1 is connected electrically to a second plate 164 through wire b2 installed inside brush rod 122.

That is, if button 151 is pressed, electric current of battery 153 flows into the first plate 162 and the second plate 164 via the path of terminal a→terminal b→insert terminal a1→wire a2→first plate 162→second plate 164→wire b2→insert terminal b1→terminal c→wire b3 by switch 152.

Working member 160 is located in the inside of brush base 142, and brush base 142 is associated at the lower end of working member holder 166 which is associated with brush rod 122.

Working member holder 166 may be formed of ceramics to absorb heat from working member 160 and supply the heat to the first plate 162 and the second plate 164.

Working member 160 is integrated with the first plate 162 and the second plate 164 of a thin metal plate where the first and second plates 162, 164 are superimposed vertically with the working member in the left and right sides. In this case, the first plate 162 is connected to insert terminal a1 via wire a2, and the second plate 164 is connected to insert terminal b1 via wire b2.

The first plate 162 and the second plate 164 of working member 160 are formed of two types of metal having different thermal expansion coefficients. The first plate 162 is formed of a metal having a high expansion rate under a heating condition (for example, nickel+manganese+iron or nickel+manganese+cupper or nickel+molybdenum+iron), and the second plate 164 is formed of a metal having a low expansion rate (for example, nickel+iron or nickel+cupper). If button 151 is pressed, the first and second plates 162, 164 are bent in an arc shape in the direction of the second plate by heat from electric current of battery 153.

Container 200 is formed as an elongated cylindrical shape. The upper mouth portion of container 200 is associated with packing 201, and the inside of container 200 is filled with a mascara material. Also, brush rod 122 and brush 140 of grip 100 are received in the inside of container 200.

The mascara brush thus configured is withdrawn from mascara container 200 by turning and opening grip 100.

Figure 4:
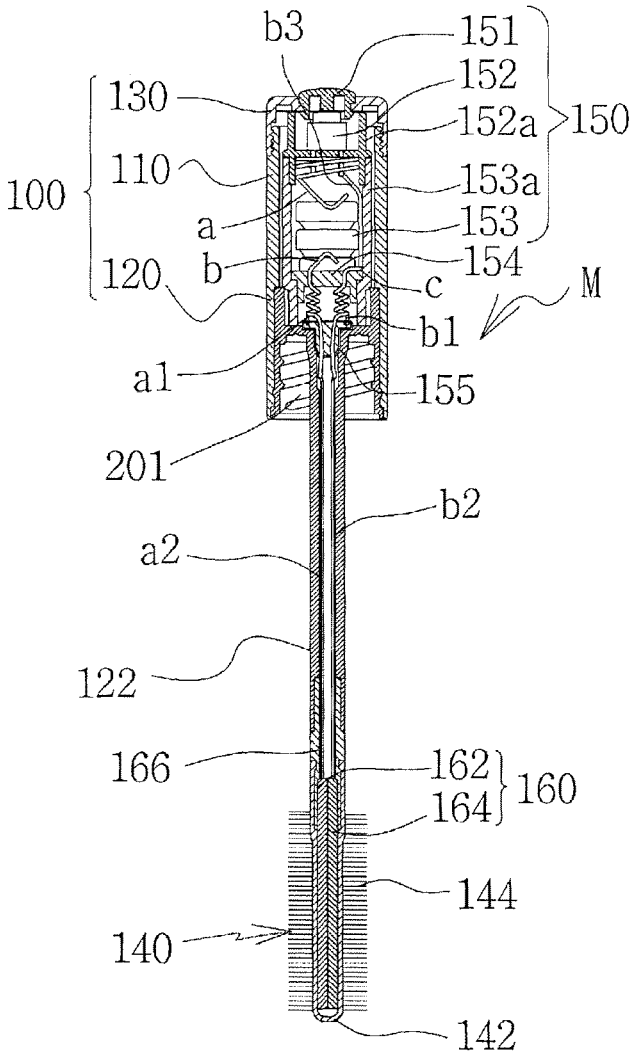
FIG. 4 is a cross-section view of a grip according to the present invention.

In case of the mascara brush withdrawn, a mascara material is adhered to brush 140 of main body M (the mascara material is not shown). Therefore, eyelashes can be made up directly using the mascara brush. However, as previously described, when brush 140 and brush rod 122 are in line as shown in FIG. 4, mascara materials adhered to brush rod 122 stain the periphery of eyes, and the mascara brush is not used as it is.

Figure 5:
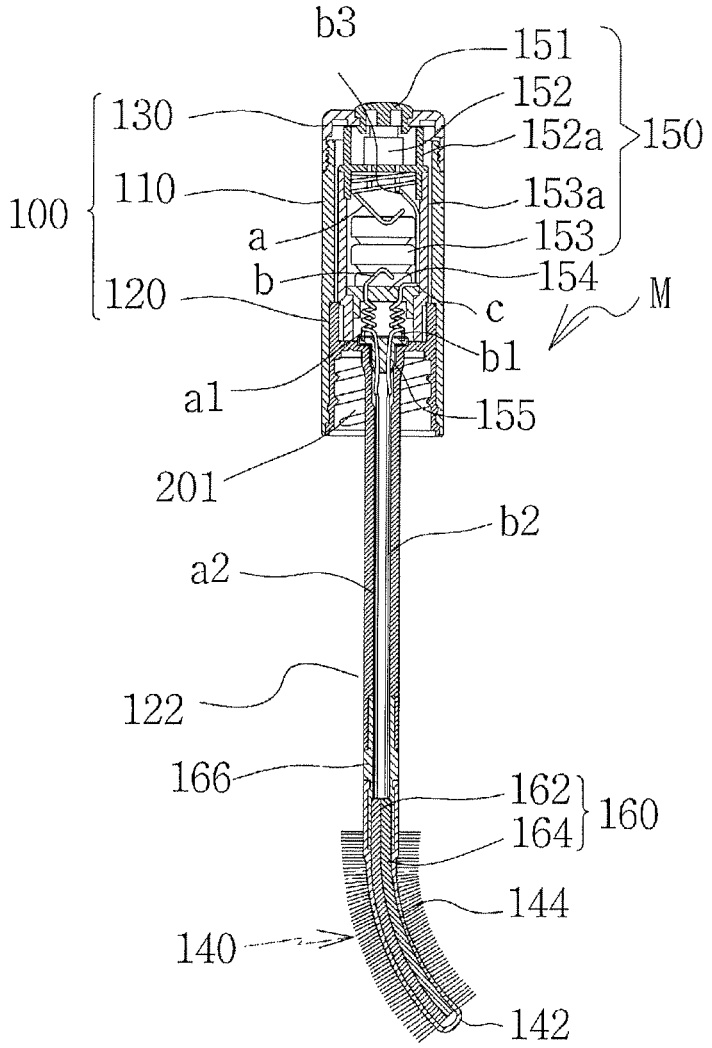
FIG. 5 is a cross-section view of a brush being bent in an arc shape according to the present invention.

According to the present invention, after mascara brush 140 is withdrawn from mascara container 200, if button 151 on grip 100 is pressed, then brush 140 is bent in an arc shape as shown in FIG. 5.

Figure 6:
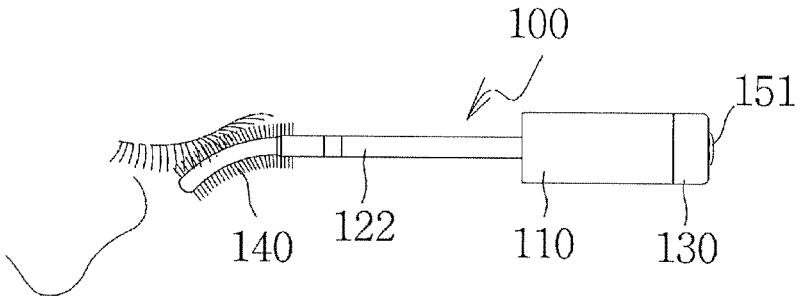
FIG. 6 shows a mascara brush in use according to the present invention.

That is, if button 151 on grip 100 is pressed, electric current of battery 153 flows into the first plate 162 and the second plate 164 via the path of terminal a→terminal b→insert terminal a1→wire a2→first plate 162→second plate 164→wire b2→insert terminal b1→terminal c→wire b3 by switch 152, and the first and second plates 162, 164 are bent in an arc shape in the direction of the second plate 164 by heat from electric current of battery 153. As a result, flexible brush base 142 enclosing the outside of the first and second plates 162, 164 is bent in an arc shape at the center on the distal end of brush rod 121. Thus, as shown in FIG. 6, eyelashes may be made up by curling eyelashes using brush 140 bent in an arc shape. In case of the mascara brush according to the present invention, brush rod 122 is handled away from the peripheral of eyes. Therefore, since brush rod 122 is not in contact with the peripheral of eyes, it is possible to prevent mascara materials adhered to the outside of brush rod 122 from staining a face.

After the use of the mascara brush, if button 151 is pressed, electric current of battery 153 is broken, and working member 160 bent in an arc shape recovers its original shape. Since this reverse mechanism is progressed by doing reversely works described above as appreciated by a person skilled in the art, the detail description for this will be omitted.

Although the present invention has been described in relation to embodiments illustrating the principle of the present invention, the present invention should not be limited to these configurations and functions described and shown above. It will be appreciated by a person skilled in the art that various modifications and variations may be made thereto without departing from the scope and spirit of the appended claims and it is to be understood that such modifications and variations and equivalents thereof fall within the scope of the present invention.

| Description of reference numbers: | |
|---|---|
| 100: Grip | 110: Outer cap |
| 120: Inner cap | 122: Brush rod |
| 130: Button cap | 140: Brush |
| 142: Brush base | 144: Brush hair |
| 150: Control member | 151: Button |
| 152: Switch | 152a: Switch holder |
| 153: Battery | 153a: Battery holder |
| 154: Terminal holder | 155: Terminal packing |
| 160: Working member | 162: First plate |
| 164: Second plate | 166: Working member holder |
| 200: Container | 201: Packing |
| a, b, c: Terminal | a1, b1: Insert terminal |
| a2, b2, b3: Electric wire | |

What is claimed is:

1. A mascara brush provided with a brush rod having a brush at one side of a grip, the brush rod is inserted into a mascara container, wherein a brush (140) is withdrawn from the mascara container (200), electric current is applied to two metal bodies being in contact with a brush base (142) having brush hairs (144), and then the brush is bent in one side direction by different thermal expansion of said two metal bodies, wherein the two metal bodies are provided in a stacked position and each of the two metal bodies is in contact with the brush base (142).

2. The mascara brush according to claim 1, wherein brush (140) provided at one side of the grip includes a working member (160) comprising a first plate (162) and a second plate (164) having different thermal extension coefficients, and brush base (142) having brush hairs (144) which encloses tightly the outside of working member (160).

3. The mascara brush according to claim 1, wherein a button (151) is provided on the top of grip (100); a switch (152), terminal jay, a battery (153), terminals (b and c), and insert terminals (a1 and b1) are sequentially associated beneath button (151); and first electric wire (a2) for connecting electrically the first plate (162) to insert terminal (a1) and second electric wire (b2) for connecting electrically the second plate (164) to insert terminal (b1) are installed in the inside of brush rod (122).

4. The mascara brush according to claim 1, wherein brush base (142) of brush (140) is associated with brush rod (122) and working member holder (166).

5. The mascara brush according to claim 4, wherein working member holder (166) is formed of ceramics.

6. The mascara brush according to claim 2, wherein a button (151) is provided on the top of grip (100); a switch (152), terminal jay, a battery (153), terminals (b and c), and insert terminals (a1 and b1) are sequentially associated beneath button (151); and first electric wire (a2) for connecting electrically the first plate (162) to insert terminal (a1) and second electric wire (b2) for connecting electrically the second plate (164) to insert terminal (b1) are installed in the inside of brush rod (122).

7. The mascara brush according to claim 2, wherein brush base (142) of brush (140) is associated with brush rod (122) and working member holder (166).

8. The mascara brush according to claim 7, wherein working member holder (166) is formed of ceramics.

* * * * *